US007093409B2

(12) United States Patent
Dutt et al.

(10) Patent No.: US 7,093,409 B2
(45) **Date of Patent: *Aug. 22, 2006**

(54) METHOD AND APPARATUS FOR MAKING RECLOSABLE PLASTIC BAGS USING A PRE-APPLIED SLIDER-OPERATED FASTENER

(75) Inventors: William Mark Dutt, Gurnee, IL (US); Toby R. Thomas, Victor, NY (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/998,115

(22) Filed: Nov. 24, 2004

(65) Prior Publication Data

US 2005/0086911 A1 Apr. 28, 2005

Related U.S. Application Data

(62) Division of application No. 09/637,038, filed on Aug. 10, 2000, now Pat. No. 6,871,473.

(51) Int. Cl.
*B65B 9/20* (2006.01)
*B65B 61/20* (2006.01)

(52) U.S. Cl. ..... 53/412; 53/133.4

(58) Field of Classification Search ..... 53/451, 53/412, 133.4, 139.2, 416; 493/213, 214
See application file for complete search history.

(56) References Cited

U.S. PATENT DOCUMENTS

| | | | |
|---|---|---|---|
| 3,381,592 | A | 5/1968 | Ravel |
| 3,473,589 | A | 10/1969 | Gotz |
| 3,532,571 | A | 10/1970 | Ausnit |
| RE27,174 | E | 9/1971 | Ausnit |
| 3,608,439 | A | 9/1971 | Ausnit |
| 3,613,524 | A | 10/1971 | Behr et al. |
| 3,701,191 | A | 10/1972 | Laguerrre |
| 3,701,192 | A | 10/1972 | Laguerre |
| 3,785,111 | A | 1/1974 | Pike |
| 3,839,128 | A | 10/1974 | Arai |
| 3,948,705 | A | 4/1976 | Ausnit |
| 4,094,729 | A | 6/1978 | Boccia |
| 4,196,030 | A | 4/1980 | Ausnit |
| 4,240,241 | A | 12/1980 | Sanborn, Jr. |
| 4,246,288 | A | 1/1981 | Sanborn, Jr. |
| 4,277,241 | A | 7/1981 | Schulze |
| 4,341,575 | A | 7/1982 | Herz |
| 4,355,494 | A | 10/1982 | Tilman |
| 4,372,793 | A | 2/1983 | Herz |
| 4,415,386 | A | 11/1983 | Ferrell et al. |
| 4,430,070 | A | 2/1984 | Ausnit |

(Continued)

FOREIGN PATENT DOCUMENTS

| | | |
|---|---|---|
| EP | 0 939 034 | 9/1999 |

(Continued)

*Primary Examiner*—John Sipos
(74) *Attorney, Agent, or Firm*—Jenkens & Gilchrist

(57) ABSTRACT

A method and apparatus for making reclosable plastic bags is provided. In the method and apparatus, a fastener is attached to a moving flat web of plastic film, preferably in the direction of web movement and near the center of the web. A plurality of sliders are mounted to the fastener either before or after the fastener is attached to the flat web, but prior to conveying the web to a FFS machine. The flat web, with the slider-operated fastener already attached thereto, is then conveyed to a vertical or horizontal FFS machine where the flat web is formed into bags, and the bags are successively filled and sealed.

13 Claims, 7 Drawing Sheets

U.S. PATENT DOCUMENTS 4,437,293 A 3/1984 Sanborn, Jr.
4,517,788 A 5/1985 Scheffers
4,528,224 A 7/1985 Ausnit
4,563,319 A 1/1986 Ausnit et al.
4,581,006 A 4/1986 Hugues et al.
4,582,549 A 4/1986 Ferrell
4,601,694 A 7/1986 Ausnit
4,617,683 A 10/1986 Christoff
4,651,504 A 3/1987 Bentsen
4,655,862 A 4/1987 Christoff et al.
4,663,915 A 5/1987 Van Erden et al.
4,666,536 A 5/1987 Van Erden et al.
4,673,383 A 6/1987 Bentsen
4,691,372 A 9/1987 Van Erden
4,703,518 A 10/1987 Ausnit
4,709,398 A 11/1987 Ausnit
4,709,533 A 12/1987 Ausnit
4,710,157 A 12/1987 Posey
4,782,951 A 11/1988 Griesbach et al.
4,787,880 A 11/1988 Ausnit
4,790,126 A 12/1988 Boeckmann
4,807,300 A 2/1989 Ausnit et al.
4,812,074 A 3/1989 Ausnit et al.
4,840,012 A 6/1989 Boeckmann
4,840,611 A 6/1989 Van Erden et al.
4,844,759 A 7/1989 Boeckmann
4,850,178 A 7/1989 Ausnit
4,876,842 A 10/1989 Ausnit
4,878,987 A 11/1989 Ven Erden
4,892,414 A 1/1990 Ausnit
4,892,512 A 1/1990 Branson
4,894,975 A 1/1990 Ausnit
4,909,017 A 3/1990 McMahon et al.
4,924,655 A 5/1990 Posey
4,925,318 A 5/1990 Sorenson
4,929,225 A 5/1990 Ausnit et al.
4,941,307 A 7/1990 Wojcik
4,969,309 A 11/1990 Schwarz et al.
4,974,395 A 12/1990 McMahon
4,993,212 A 2/1991 Veoukas
5,005,707 A 4/1991 Hustad et al.
5,014,498 A 5/1991 McMahon
5,027,584 A 7/1991 McMahon et al.
5,036,643 A 8/1991 Bodolay
5,042,224 A 8/1991 McMahon
5,046,300 A 9/1991 Custer et al.
5,063,639 A 11/1991 Boeckmann et al.
5,072,571 A 12/1991 Boeckmann
5,085,031 A 2/1992 McDonald
5,092,831 A 3/1992 James et al.
5,096,516 A 3/1992 McDonald et al.
5,105,603 A 4/1992 Natterer
5,107,658 A 4/1992 Hustad et al.
5,111,643 A 5/1992 Hobock
5,116,301 A 5/1992 Robinson et al.
5,127,208 A 7/1992 Custer et al.
5,147,272 A 9/1992 Richison et al.
5,179,816 A 1/1993 Wojnicki
5,188,461 A 2/1993 Sorensen
5,211,482 A 5/1993 Tilman
5,247,781 A 9/1993 Runge
5,254,073 A 10/1993 Richison et al.
5,259,904 A 11/1993 Ausnit
5,273,511 A 12/1993 Boeckmann
5,322,579 A 6/1994 Van Erden
5,334,127 A 8/1994 Bruno et al.
5,383,989 A 1/1995 McMahon
5,400,565 A 3/1995 Terminella et al.
5,400,568 A 3/1995 Kanemitsu et al.
5,405,629 A 4/1995 Marnocha et al.
5,412,924 A 5/1995 Ausnit
5,415,904 A 5/1995 Takubo et al.
5,425,216 A 6/1995 Ausnit
5,425,825 A 6/1995 Racko et al.
5,435,864 A 7/1995 Machacek et al.
5,470,156 A 11/1995 May
5,489,252 A 2/1996 May
5,492,411 A 2/1996 May
5,505,037 A 4/1996 Terminella et al.
5,509,735 A 4/1996 May
5,511,884 A 4/1996 Bruno et al.
5,519,982 A 5/1996 Herber et al.
5,525,363 A 6/1996 Herber et al.
5,542,902 A 8/1996 Richison et al.
5,551,127 A 9/1996 May
5,551,208 A 9/1996 Van Erden
5,557,907 A 9/1996 Malin et al.
5,558,613 A 9/1996 Tilman et al.
5,561,966 A 10/1996 English
5,564,259 A 10/1996 Stolmeir
5,573,614 A 11/1996 Tilman et al.
5,592,802 A 1/1997 Malin et al.
5,613,934 A 3/1997 May
5,628,566 A 5/1997 Schreiter
5,647,671 A 7/1997 May
5,669,715 A 9/1997 Dobreski et al.
5,682,730 A 11/1997 Dobreski
5,725,312 A 3/1998 May
5,782,733 A 7/1998 Yeager
5,788,378 A 8/1998 Thomas
5,823,933 A 10/1998 Yeager
5,833,791 A 11/1998 Bryniarski et al.
5,906,438 A 5/1999 Laudenberg
5,956,924 A 9/1999 Thieman
6,044,621 A 4/2000 Malin et al.
6,138,436 A 10/2000 Malin et al.
6,138,439 A 10/2000 McMahon et al.
6,212,857 B1 * 4/2001 Van Erden ..... 53/412
6,216,423 B1 4/2001 Thieman ..... 53/412
6,286,189 B1 * 9/2001 Provan et al. ..... 24/30.5 R
6,289,561 B1 9/2001 Provan et al. ..... 24/415
6,292,986 B1 9/2001 Provan et al. ..... 24/415
6,293,896 B1 * 9/2001 Buchman ..... 493/213
6,327,754 B1 12/2001 Belmont et al. ..... 24/400
6,347,437 B1 2/2002 Provan et al. ..... 24/400
6,360,513 B1 3/2002 Strand et al. ..... 53/412
6,363,692 B1 4/2002 Thieman ..... 53/412
6,412,254 B1 7/2002 Tilman ..... 53/412
6,427,421 B1 8/2002 Belmont et al. ..... 53/412
6,470,551 B1 10/2002 Provan et al. ..... 29/408
6,499,272 B1 12/2002 Thieman ..... 53/412
6,871,473 B1 * 3/2005 Dutt et al. ..... 53/133.4

FOREIGN PATENT DOCUMENTS

EP 0 978 450 2/2000
EP 1 026 077 A2 9/2000
GB 2 085 519 4/1982
WO 99/24325 5/1999

* cited by examiner

METHOD AND APPARATUS FOR MAKING RECLOSABLE PLASTIC BAGS USING A PRE-APPLIED SLIDER-OPERATED FASTENER

RELATED APPLICATIONS

This application is a divisional of U.S. patent application Ser. No. 09/637,038, filed Aug. 10, 2000, now U.S. Pat. No. 6,871,473. issued on Mar. 29, 2005. which is herein incorporated by reference in its entirety. The parent case U.S. patent application Ser. No. 09/637,038 (now U.S. Pat. No. 6,871,473) was concurrently filed with U.S. patent application Ser. No. 09/636,244 (now U.S. Pat. No. 6,508,969, which issued on Jan. 21, 2003) entitled "Injection-Molded End Stop for a Slider-Operated Fastener," U.S. patent application Ser. No. 09/636,421 (now U.S. Pat. No. 6,470,551, which issued on Oct. 29, 2002) entitled "Slider-Operated Fastener With Spaced Notches and Associated Preseals," U.S. patent application Ser. No. 09/637,037 (now U.S. Pat. No. 6,526,726, which issued on Mar. 4, 2003) entitled "Method of Applying a Slider to a Fastener-Carrying Plastic Web," and U.S. patent application Ser. No. 09/635,451 (now U.S. Pat. No. 6,494,018, which issued on Dec. 17, 2002) entitled "Method and Apparatus for Guiding a Fastener in a Bag Making Machine," all of which are incorporated herein by reference in their entireties.

FIELD OF THE INVENTION

The present invention generally relates to methods and apparatus for manufacturing reclosable plastic bags and, more particularly, to a method and apparatus for manufacturing reclosable plastic bags using a pre-applied slider-operated fastener.

BACKGROUND OF THE INVENTION

The term form-fill-seal (FFS) means producing a bag or pouch from a flexible packaging material, inserting a measured amount of product, and closing the bag. Two distinct principles are utilized for FFS packaging: horizontal and vertical. In a typical vertical FFS machine, for example, a flat web of plastic film is shaped around a bag-forming tube. As the shaped web moves down around the forming tube, the opposing edges of the web are overlapped for either a fin or lap seal. At this point, with the web wrapped around the tube, the web moving vertically down along the bag-forming tube will be sealed. A vertical seal mechanism forms the fin or lap seal to make the web into a tube, and a cross-seal mechanism forms a cross-seal beneath the bag-forming tube to simultaneously seal the top of a filled bag and the bottom of a succeeding empty bag. After sealing the bottom of the succeeding empty bag, the succeeding empty bag is filled with a product dropped through the bag-forming tube.

If the bag is to be reclosable, a fastener is typically attached to the inner surface of the web. The fastener may be continuous and move in the same direction as the web, or the fastener may be divided into individual bag-width segments applied transverse to the direction of web movement. To facilitate operation of the reclosable fastener, a slider may be slidably mounted thereto. The slider engages the fastener's interlocking profiles while moved in one direction, and disengages the profiles while moved in the opposite direction.

Heretofore, it has been proposed to attach the slider-operated fastener to the web as the web moves through the FFS machine. For example, in one proposed technique used on vertical FFS machines, the sliders are mounted to the fastener prior to the bag-forming tube and the slider-operated fastener is subsequently attached to the web as the web moves down the bag-forming tube. In another technique the fastener is attached to the web as the web moves down the bag-forming tube and the sliders are subsequently mounted to the fastener. Such techniques for attaching the slider-operated fastener to the web are closely dependent upon the FFS machine, can adversely affect the machine's efficiency and performance, and require significant modifications to standard FFS machines in order for such machines to handle the sliders and fastener.

SUMMARY OF THE INVENTION

To overcome the aforementioned shortcomings, the present invention provides a method and apparatus for making reclosable plastic bags using a pre-applied slider-operated fastener. In the method and apparatus, a fastener is attached to a moving flat web of plastic film, preferably in the direction of web movement and near the center of the web. A plurality of sliders are mounted to the fastener either before or after the fastener is attached to the flat web, but prior to conveying the web to a FFS machine. The flat web, with the slider-operated fastener already attached thereto, is then conveyed to a vertical or horizontal FFS machine where the flat web is formed into bags, and the bags are successively filled and sealed.

A significant advantage of attaching the slider-operated fastener to the flat web upstream from the FFS machine is that the operations of mounting the sliders to the fastener and attaching the fastener to the flat web can be performed independently from the FFS machine and therefore do not adversely impact the FFS machine's efficiency and performance. The performance of the FFS machine can be measured by such parameters as the machine's filling rate, cycle speed, scrap/reclaim generation, etc. Also, by pre-applying the slider-operated fastener to the flat web, a broad range of current FFS machines can be easily retrofitted to handle the web with minimal customization.

BRIEF DESCRIPTION OF THE DRAWINGS

Other objects and advantages of the invention will become apparent upon reading the following detailed description and upon reference to the drawings in which.

Figure 1:
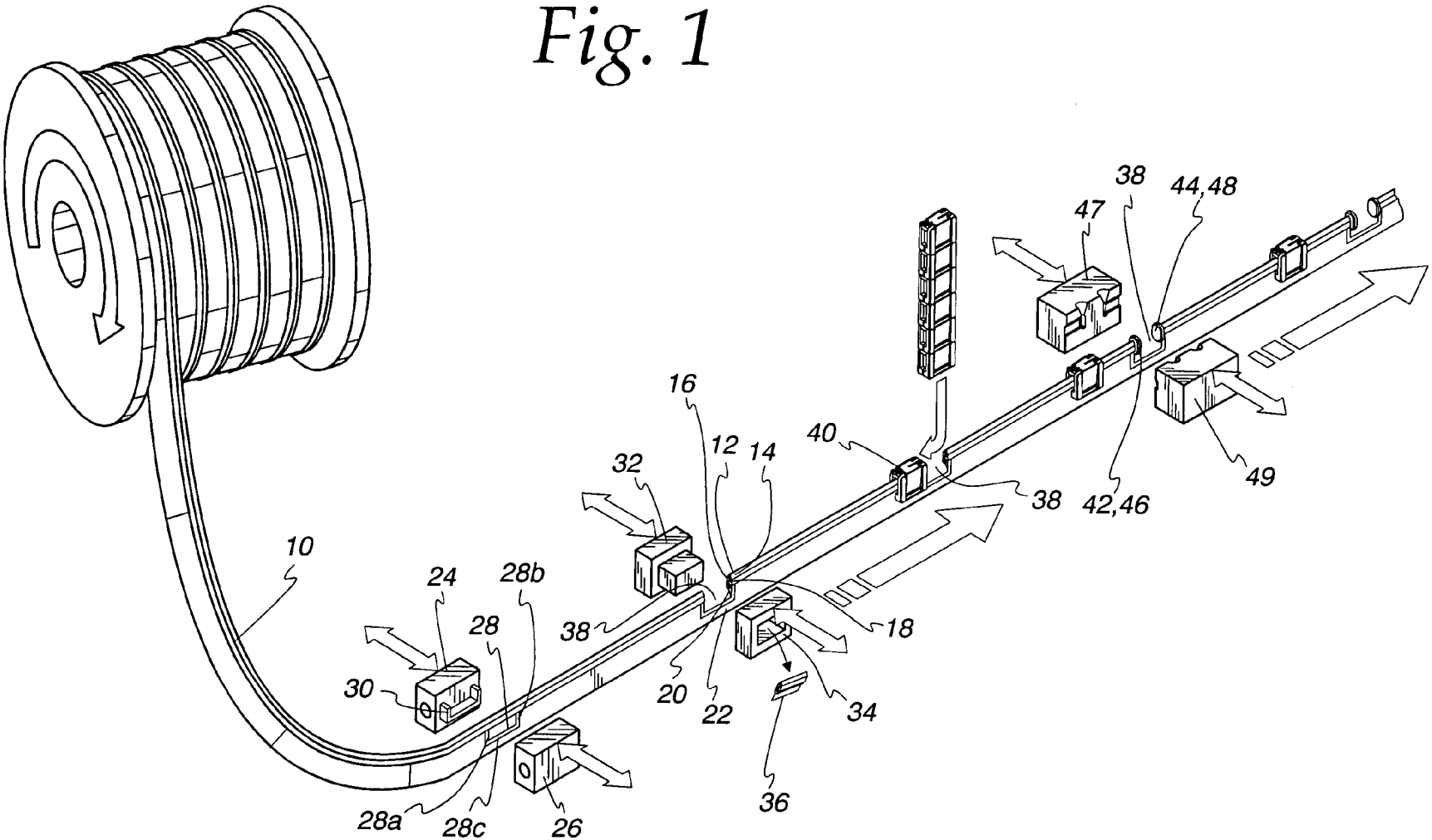
FIG. 1 depicts a method of making a slider-operated fastener.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF ILLUSTRATIVE EMBODIMENTS

Turning to the drawings, FIG. 1 depicts a method of making a slider-operated fastener for use in reclosable plastic bags. In the method, there is provided a continuous fastener 10 including first and second opposing tracks 12 and 14. The tracks 12 and 14 include respective first and second interlocking profiles 16 and 18 and respective first and second fins 20 and 22 extending downward from the respective profiles 16 and 18. The profile 16 preferably includes a rib, and the profile 18 preferably includes a groove for receiving the rib. Further details concerning the construction of the profiles 16 and 18 may be obtained from U.S. Pat. No. 5,007,143 to Herrington, which is incorporated herein by reference in its entirety. The fastener 10 may be unwound from a spool or the like.

The fastener 10 is conveyed by rollers and the like (not shown) to a preseal station. The preseal station includes a pair of reciprocating seal bars 24 and 26. Either both of the seal bars 24 and 26 move back and forth between open and closed positions, or one of the seal bars is stationary while the other seal bar moves back and forth. At least the seal bar 24 is heated. The other bar 26 may be heated as well, or may simply serve as a backing against which the heated seal bar 24 applies pressure when the seal bars 24 and 26 are brought together. The temperature, pressure, and dwell time of the seal bars 24 and 26 are properly adjusted to allow the seal bars 24 and 26 to impart a U-shaped preseal 28. While the fastener 10 is temporarily stopped at the preseal station, the fins 20 and 22 are sealed to each other along the U-shaped preseal 28. The preseal 28 includes a pair of opposing sides 28*a*, 28*b* and a bottom 28*c* bridging the opposing sides. The opposing sides 28*a*, 28*b* are generally located along an upper portion of the fins 20 and 22 and extend downward from the interlocked profiles 16 and 18. The bottom 28*c* is located along a lower portion of the fins 20 and 22. The seal bar 24 has a U-shaped projection 30 corresponding to the shape of the preseal 28. Although the preseal 28 is illustrated as being generally U-shaped, the area between the sides 28*a*, 28*b* of the preseal 28 may be sealed as well so that the preseal 28 appears like a solid rectangle. The preseal 28 preferably does not extend into the profiles 16 and 18 due to the technique for installing sliders on the fastener 10 later in the manufacturing process.

After forming the preseal 28, the fastener 10 is conveyed to a notching station. The notching station includes a pair of reciprocating cutters 32 and 34. Either both of the cutters 32 and 34 move back and forth between open and closed positions, or one of the cutters is stationary while the other cutter moves back and forth. The cutter 32 forms a rectangular projection, while the cutter 34 forms a rectangular hole for receiving the projection. The fastener 10 is temporarily stopped at the notching station with the preseal 28 aligned between the separated cutters 32 and 34. While the fastener 10 is stopped, the cutters 32 and 34 are brought together such that the rectangular projection of the cutter 32 punches a rectangular section 36 through the rectangular hole of the cutter 34, thereby leaving a U-shaped notch 38 in the fastener 10. Prior to being punched out, the rectangular section 36 is disposed between the opposing sides 28*a*, 28*b* of the preseal 28 and above the bottom 28*c* of the preseal 28. Therefore, the preseal 28 generally encompasses the notch 38 and defines a periphery thereof such that the preseal provides a leak-resistant barrier to entry into an interior of the fastener 10 between the fins 20 and 22 via the notch 38. As discussed below, the leak-resistant barrier effectively minimizes leaks in the reclosable plastic bags ultimately formed by the manufacturing process.

After forming the notch 38, the fastener 10 is conveyed to a slider insertion station. While the fastener 10 is temporarily stopped at the slider insertion station, a slider 40 from a source of multiple sliders is positioned within the notch 38. Further details concerning the source of multiple sliders may be obtained from U.S. patent application Ser. No. 09/307,893 (PCOS013) entitled "Assembly and Accumulation of Sliders for Profiled Zippers", filed May 10, 1999, and incorporated herein by reference in its entirety. The slider 40 is then threaded onto the fastener 10 in response to relative movement of the slider 40 and the fastener 10. Further details concerning the equipment for installing the slider 40 onto the fastener 10 via the notch 38 may be obtained from U.S. patent application Ser. No. 09/307,937 (PCOS015) entitled "Zipper and Zipper Arrangements and Methods of Manufacturing the Same", filed May 10, 1999, and incorporated herein by reference in its entirety. Instead of inserting the slider 40 onto the fastener 10 via the notch 38, the slider 40 may be constructed to allow for various other types of installations. For example, the slider may be a multipart plastic slider including a separator finger and two side walls mechanically joined together in place on the fastener. This multipart slider is disclosed in U.S. Pat. Nos. 5,007,142 and 5,426,830, which are incorporated herein by reference in their entireties. The slider may have one or more hinged wings that fold and snap permanently in place to attach it to the fastener. This foldable slider is disclosed in U.S. Pat. Nos. 5,010,627, 5,063,644, 5,070,583, and 5,448,808, which are incorporated herein by reference in their entireties. The slider may have semi-flexible side walls that allow the slider to be pushed downward onto the fastener from above. Similarly, the slider may be flexible and including a post-installation rigidizing structure as disclosed in U.S. Pat. No. 5,283,932, which is incorporated herein by reference in its entirety.

After installing the slider 40 onto the fastener 10, the fastener 10 is conveyed to an end stop applicator. The end stop applicator applies end stops 42 and 44 to the respective fastener ends 46 and 48 on opposite sides of the notch 38. In the plastic bags ultimately formed by the manufacturing process, the end stop 42 will be located at the fastener end 46 of one bag, while the end stop 44 will be located at the fastener end 48 of the adjacent bag. The end stops perform three primary functions: (1) preventing the slider 40 from going past the ends of the fastener, (2) holding the profiles together to resist stresses applied to the profiles during normal use of the plastic bag, and (3) minimizing leakage from inside the plastic bag out through the fastener ends.

In one embodiment, the end stop applicator includes a pair of chilled, reciprocating molds 47 and 49. Either both of the molds 47 and 49 move back and forth between open and closed positions, or one of the molds is stationary while the other mold moves back and forth. While the fastener 10 is temporarily stopped, the molds 47 and 49 close around the fastener ends 46 and 48. A predetermined amount of flowable plastic material is then forced around and between the profiles 16 and 18 at the fastener ends 46 and 48 by a conventional back pressure device (not shown) coupled to the supply tube. The molds 47 and 49 form channels for receiving the plastic material and guiding it to the fastener ends 46 and 48. Further details concerning the injection-molded end stops 42 and 44 and the method of making the same may be obtained from U.S. patent application Ser. No. 09/636,244 entitled "Injection-Molded End Stop for a Slider-Operated Fastener", filed concurrently herewith, and incorporated herein by reference in its entirety.

Instead of applying injection-molded end stops, other types of end stops may be applied to the fastener ends 46 and 48, including those disclosed in U.S. Pat. Nos. 5,924,173, 5,833,791, 5,482,375, 5,448,807, 5,442,837, 5,405,478, 5,161,286, 5,131,121, 5,088,971, and 5,067,208, which are incorporated herein by reference in their entireties. In U.S. Pat. No. 5,067,208, for example, each end stop is in the form of a fairly rigid strap/clip that wraps over the top of the fastener. One end of the strap is provided with a rivet-like member that penetrates through the fastener fins and into a cooperating opening at the other end of the strap.

While the fastener 10 is temporarily stopped in the method depicted in FIG. 1, the various stations simultaneously perform their respective functions on different parts of the continuous fastener 10 spaced approximately at bag-width distances apart. Therefore, as the preseal station forms a new preseal 28, (1) the notching station forms a new notch 38 within a previously formed preseal, (2) the slider insertion station installs a slider 40 via a previously formed notch, and (3) the end stop applicator applies new end stops 42 and 44 proximate a previously installed slider. After each of the stations has completed its respective function on the stopped fastener 10, movement of the fastener 10 is resumed. The fastener 10 is moved for approximately a bag-width distance so that the next station can perform its respective function. The preseals 28 are advantageous in that they allow the fastener 10 to be controlled during such downstream operations as notch formation, slider installation, and end stop installation and when the fastener 10 is tensioned by various rollers in the bag making machine. The preseals 28 keep the interlocked profiles 16 and 18 together and prevent them from moving longitudinally relative to each other.

After applying the end stops 42 and 44, the fastener 10 is preferably applied to a moving flat web of plastic film that is then formed into individual plastic bags. Alternatively, the fastener 10 may be conveyed to a storage medium, such as a spool, and placed in an intermediate storage facility, and then applied to the moving web at a later time.

Figure 2:
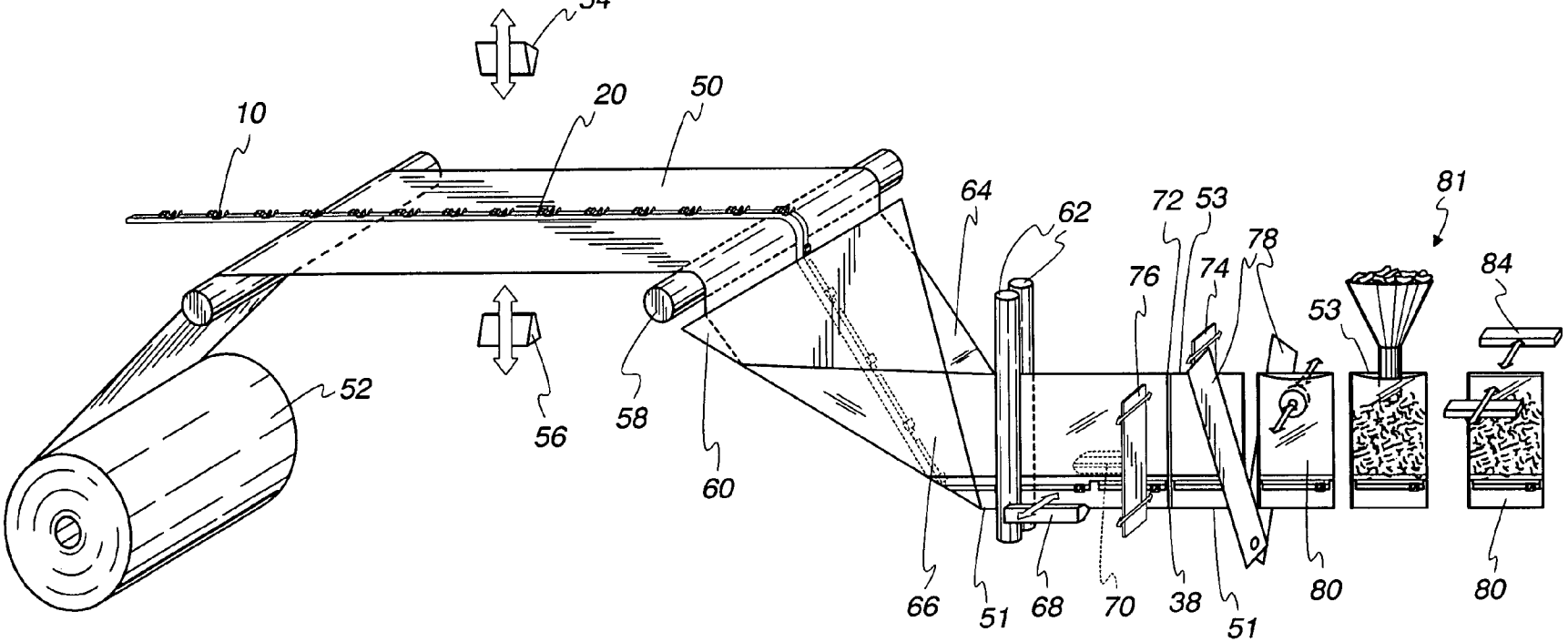
FIG. 2 depicts a method and apparatus for attaching the slider-operated fastener to a flat web of plastic film and then conveying the web to a horizontal FFS machine.

FIG. 2 depicts a method and apparatus for attaching the slider-operated fastener 10 to a flat web 50 of plastic film and then conveying the web 50 to a horizontal FFS machine. The fin 20 of the fastener 10 is "tacked" or lightly sealed to a moving web 50 of plastic film unwound from a film roll 52. To tack the fastener fin 20 to the moving web 50, there is provided a pair of reciprocating seal bars 54 and 56. Either both of the seal bars 54 and 56 move back and forth between open and closed positions, or one of the seal bars is stationary while the other seal bar moves back and forth. Both the fastener 10 and the web 50 are temporarily stopped while the seal bars are brought together to tack the fastener 10 to the web 50. Of course, if the fastener 10 produced by the method in FIG. 1 is conveyed directly to the web 50, as opposed to an intermediate storage facility, the stoppage of the fastener 10 and web 50 for tacking can be made to coincide with the stoppage of the fastener 10 in FIG. 1 for forming the preseal and notch and installing the slider and end stops. In an alternative embodiment, the seal bars 54 and 56 are replaced with a continuous heat sealing mechanism such as a static hot air blower that blows hot air onto the moving fastener. The tacked fastener 10 is carried with the moving web 50 without shifting relative thereto.

After tacking the fastener 10 to the web 50, the fastener-carrying web 50 is conveyed to the horizontal FFS machine. At a folding station of the FFS machine, the web 50 is folded in half with the fastener 10 inside the web 50 and proximate the fold 51. To fold the web 50, the web 50 is conveyed over a horizontal roller 58, under a triangular folding board 60, and then between a pair of closely spaced vertical rollers 62. The folded web 50 includes a pair of overlapping panels 64 and 66 joined along the fold 51.

After folding the web 50, the fastener fins 20 and 22 are permanently sealed to the respective web panels 66 and 64 by respective seal bars 68 and 70. The seal bars 68 and 70 are sufficiently wide that they generate the fin seals across the entire width of a bag. Either both of the seal bars 68 and 70 move back and forth between open and closed positions, or one of the seal bars is stationary while the other seal bar moves back and forth. The fastener-carrying web 50 is temporarily stopped while the seal bars are brought together to seal the fastener 10 to the web 50. Both of the seal bars 68 and 70 are preferably heated. The temperature, pressure, and dwell time of the seal bars 68 and 70 are properly adjusted to allow the seal bars 68 and 70 to generate the permanent fin seals. In an alternative embodiment, the seal bars 68 and 70 are replaced with a continuous heat sealing mechanism such as a pair of hot air blowers that blow heated air onto the respective fastener fins.

After sealing the fins 20 and 22 to the respective web panels 66 and 64, the web panels 64 and 66 are sealed to each other along a side seal 72 by a pair of reciprocating seal bars 74 and 76. The side seal 72 is transverse to a direction of movement of the folded web 50 and is aligned with a center of the notch 38 (and preseal 28). Also, the side seal 72 extends from the folded bottom 51 to an open top 53 of the folded web 50. Either both of the seal bars 74 and 76 move back and forth between open and closed positions, or one of the seal bars is stationary while the other seal bar moves back and forth. The folded web 50 is temporarily stopped while the seal bars are brought together to seal the web panels 64 and 66 to each other. At least the seal bar 74 is heated. The other bar 76 may be heated as well, or may simply serve as a backing against which the heated seal bar 74 applies pressure when the seal bars 74 and 76 are brought together. The temperature, pressure, and dwell time of the seal bars 74 and 76 are properly adjusted to allow the seal bars 74 and 76 to generate the side seal 72.

After generating the side seal 72, the folded web 50 is conveyed to a cutter 78 for separating the folded web 50 into individual plastic bags. While the folded web 50 is temporarily stopped, the cutter 78 cuts the folded web 50 along a center of the side seal 72 to produce the individual plastic bag 80. The plastic bag 80 is filled with a product through its open top 53 at a filling station 81. Finally, the open top 53 is sealed by a heat sealing mechanism 84. The end result is a filled and sealed bag 80 ready for shipment to a customer such as a grocery store or convenience store.

While the web 50 is temporarily stopped in the method depicted in FIG. 2, the various stations simultaneously perform their respective functions on different parts of the continuous web 50. For example, as the fastener 10 is tacked to the web 50 by the seal bars 54 and 56, (1) the fastener fins 20 and 22 of a previously tacked section of the fastener 10 can be permanently sealed to the respective web panels 64 and 66 by respective seal bars 68 and 70, (2) the web panels 64 and 66 carrying previously sealed fastener fin sections can be sealed to each other along a side seal 72 by the seal bars 74 and 76, and (3) the folded web 50 can be cut along a previously generated side seal. After each of the stations has completed its respective function on the stopped web 50, movement of the web 50 is resumed.

Figure 6:
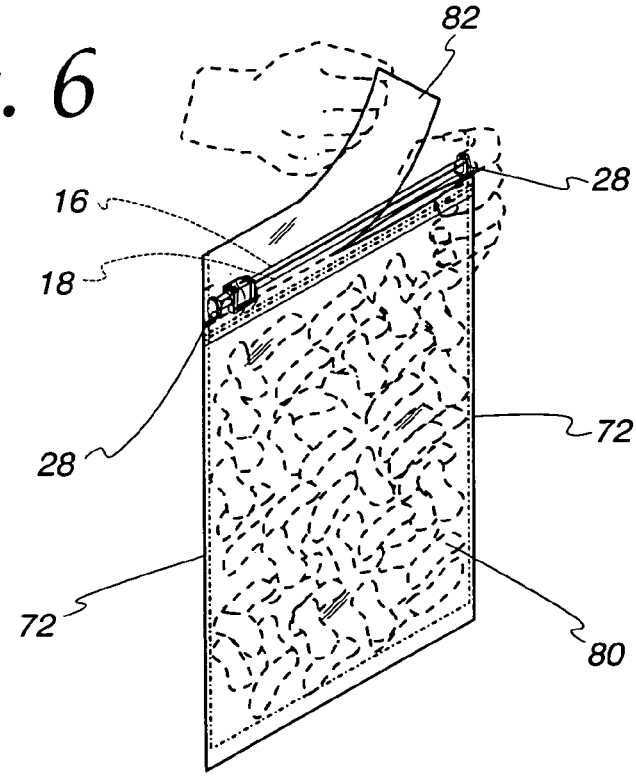
FIG. 6 is an isometric view of a partially-opened finished bag produced by the methods and apparatus of FIGS. 2 and 3.

The finished bag 80, with its header 82 partially removed by an end user, is illustrated in FIG. 6. After the header 82 is fully removed, each preseal 28 intersects both the adjacent side seal 72 and the fastener profiles 16 and 18, thereby providing a leak-resistant barrier between an interior and an exterior of the bag 80. When the profiles 16 and 18 are interlocked but the header 82 has been removed, this leak-resistant barrier minimizes food spoilage and leakage of product from inside the bag.

Figure 3:
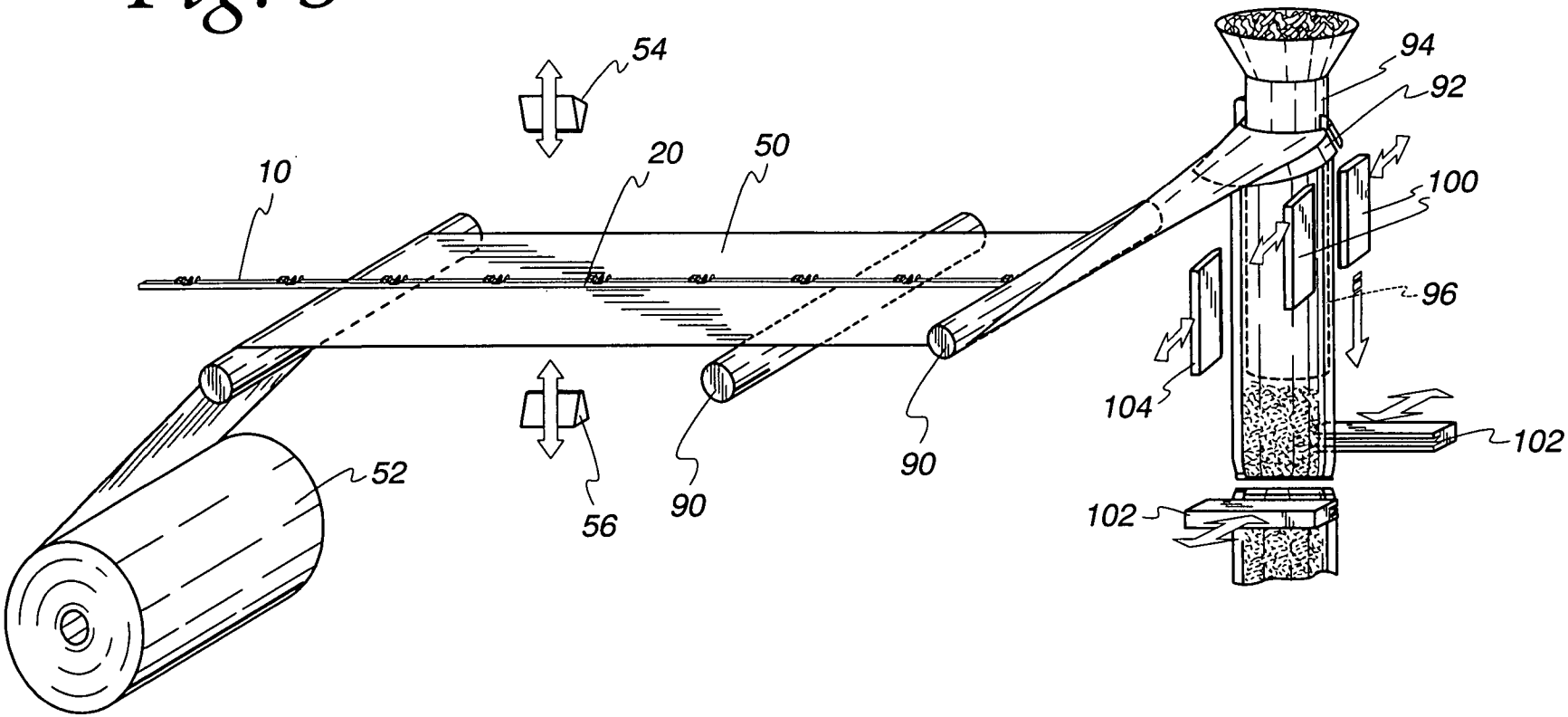
FIG. 3 depicts a method and apparatus for attaching the slider-operated fastener to a flat web of plastic film and then conveying the web to a vertical FFS machine.
Figure 4:
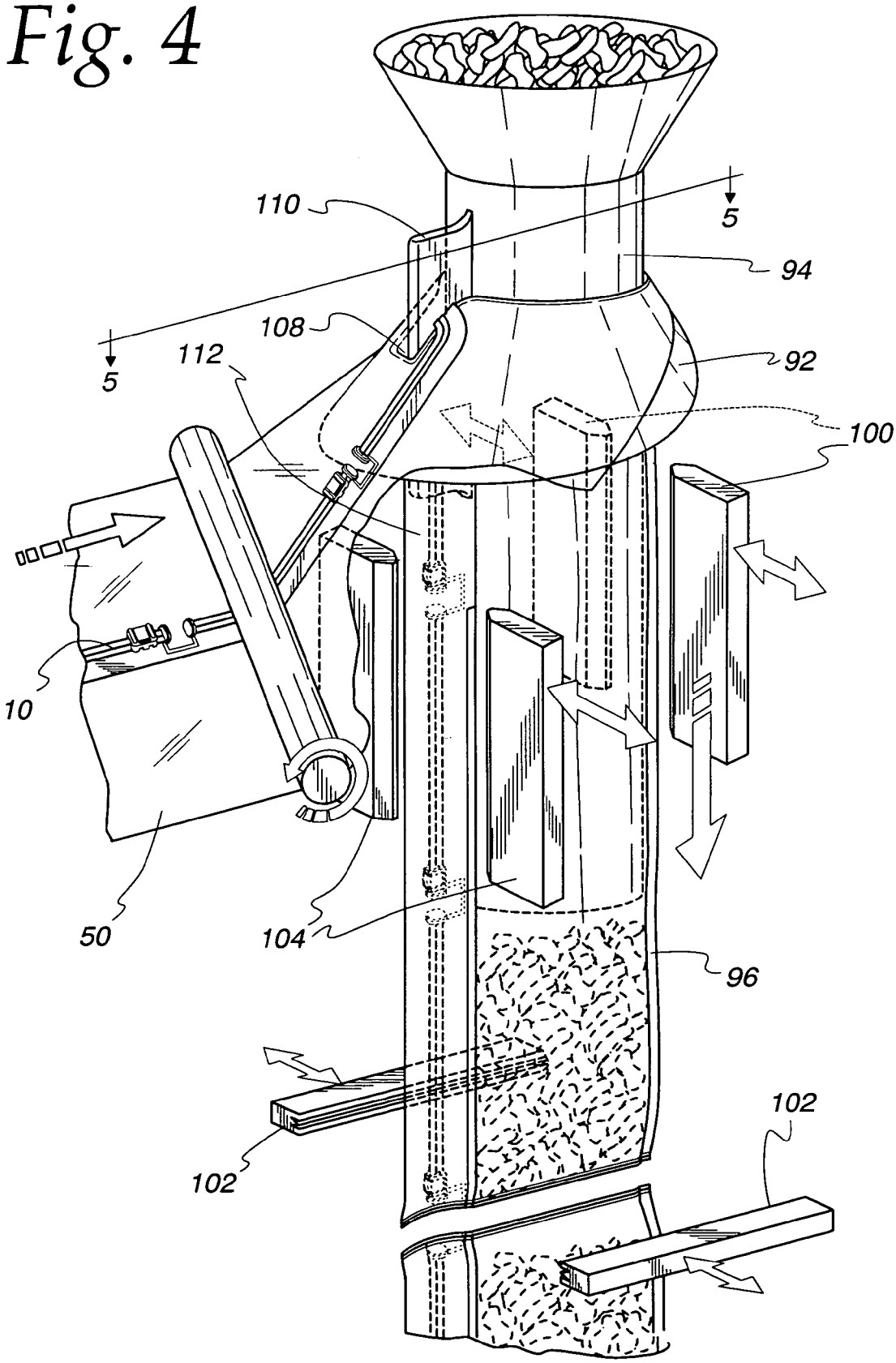
FIG. 4 is an enlarged isometric view of the vertical FFS machine.
Figure 5:
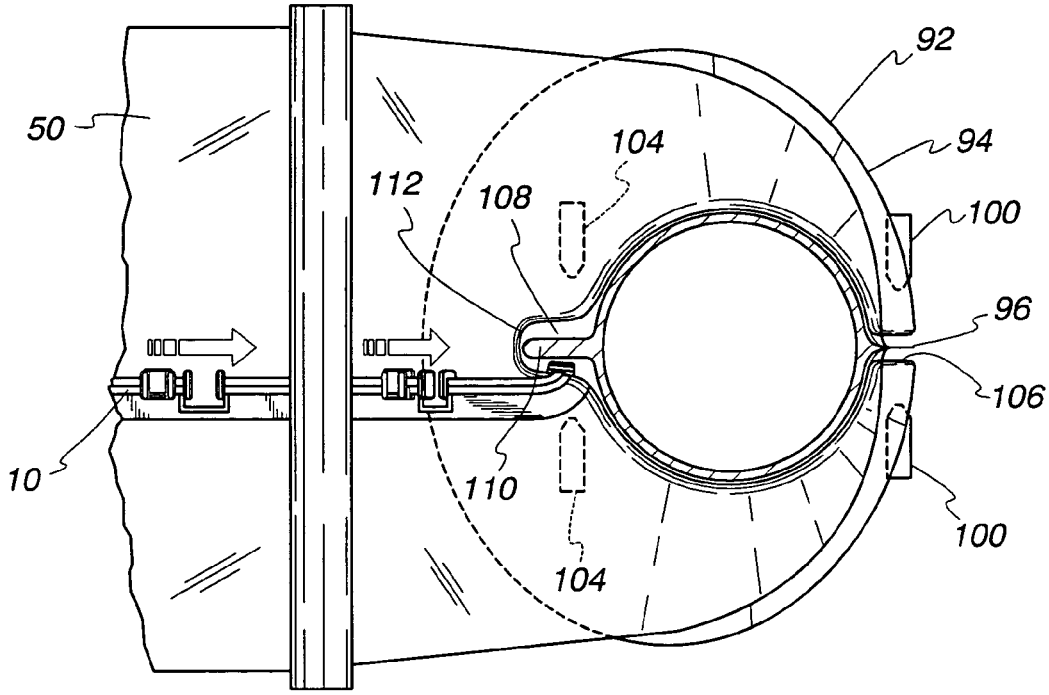
FIG. 5 is a section taken generally along line 5—5 in FIG. 4.

The finished bag 80 may alternatively be produced by the method and apparatus depicted in FIGS. 3–5. FIGS. 3–5 depict a method and apparatus for attaching the slider-operated fastener 10 to the flat web 50 of plastic film and then conveying the web 50 to a vertical FFS machine. Using the seal bars 54 and 56 discussed above, the fin of the fastener 10 is "tacked" or lightly sealed to the moving web 50 of plastic film unwound from a film roll 52. After tacking the fastener 10 to the web 50, the fastener-carrying web 50 is conveyed to the vertical FFS machine, which forms and fills vertically instead of horizontally.

The vertical FFS machine produces flexible bags from the flat web 50, which has the slider-operated fastener 10 already attached thereto. The web 50 is fed through a series of rollers 90 to a bag-forming collar/tube, where the finished bag 80 is formed. The roller arrangement (which may include more than the two illustrated rollers 90) maintains minimum tension and controls the web 50 as it passes through the machine, preventing overfeed and whipping action.

The bag-forming collar or shoulder 92 receives the web 50 from the rollers and changes the web travel from a flat plane and shapes it around a bag-forming tube 94. As the wrapping web 50 moves down around the bag-forming tube 94, the opposing vertical edges of the web 50 are overlapped for either a fin or lap seal 96. A fin seal 96, which is shown in FIGS. 3–5, can be made of materials with sealing properties on only the inner side of the web, because the heat sealable surface seals to itself. A lap seal uses slightly less material, but it requires sealing properties on both sides of the web because the lap is made by sealing the inner ply of one edge to the outer ply of the other edge.

At this point, with the web 50 wrapped around the bag-forming tube 94, the actual sealing functions start. The overlapped vertical edges moving vertically down along the bag-forming tube 94 are sealed. The web 50 advances a predetermined distance that equals the desired bag-width dimension. To advance the web 50, a pair of conventional draw-down drive belts (not shown) may be located on opposite sides of the bag-forming tube 94. The drive belts are sufficiently close to the tube 94 to both draw the wrapped web 50 downward and pull additional web material through the collar 92. The bag width (vertical direction in FIGS. 3 and 4) is the extent of the material hanging down from the bottom of the bag-forming tube 94. The bag height (horizontal direction in FIGS. 3 and 4) is approximately equal to one-half of the outside circumference dimension of the bag-forming tube 94. After the film advance is completed, the bag-sealing and filling completes the remainder of one cycle (film advance/fill/seal).

There are three sets of sealing tools on the FFS machine. First, a pair of reciprocating vertical (longitudinal) seal bars 100 are mounted adjacent to the face of the bag-forming tube 94 and are positioned to seal the fin (or lap) seal 96 that makes the web 50 into a tube. The fin seal 96 forms the bottom of the finished bag 80 in FIG. 6. Second, front and rear cross-sealing (horizontal) jaws 102 combine top- and bottom-sealing sections with a bag cutoff device in between. The top-sealing portion seals the "bottom" of a succeeding empty bag suspended down from the bag-forming tube 94, and the bottom portion seals the "top" of a filled bag. The "bottom" and "top" actually correspond to the sides 72 of the finished bag 80 in FIG. 6. The cutoff device, which can be a knife or a hot wire, operates during the jaw closing/sealing operation. This means that when the jaws 102 are open, the filled bag is released from the machine. As best shown in FIG. 4, the cross (end) seals are generated in line with the preseals and notches produced by the fastener manufacturing method in FIG. 1.

Third, a pair of reciprocating vertical (longitudinal) seal bars 104 are mounted adjacent to the face of the bag-forming tube 94 diametrically opposite from the seal bars 100 used to generate the fin seal 96. The seal bars 104 are positioned to permanently seal the fastener fins 20 and 22 to opposing sides of a C-fold 112 of the web 50. The seal bars 104 are sufficiently long that they generate the seals across the entire width (vertical direction in FIGS. 3 and 4) of a bag produced by the vertical FFS machine.

As best shown in FIGS. 4 and 5, the bag-forming collar 92 includes a pair of slots 106 and 108 diametrically opposite to each other when the collar 92 is viewed from above (see FIG. 5). The conventional exterior slot 106 intersects the outer periphery of the collar 92 and is used to position the opposing longitudinal edges of the web 50 adjacent to each other in preparation for the fin seal 96. The interior U-shaped slot 108 cooperates with a folding plate 110 attached to an outer surface of the bag-forming tube 94 to create the C-fold 112 in the web 50. The interior slot 108 opens toward the bag-forming tube 94 and accommodates the folding plate 110. There is a small gap between the collar 92 and the folding plate 110 at the location of the interior slot 108. The folding plate 110 starts above the collar 92 and extends vertically downward below the collar 92 to a height just above the seal bars 104. The C-fold 112 is diametrically opposite the fin seal 96. Also, the fastener 10 is positioned slightly off the centerline between the longitudinal edges of the flat web 50 so that when the fastener 10 is drawn through the interior slot 108 of the collar 92, the fastener 10 is located to one side of the C-fold 112. The seal bars 104 permanently seal the fastener fins to the opposing sides of the C-fold 112. The folding plate 110 is located entirely above the seal bars 104 so that the folding plate 110 does not interfere with this sealing operation.

The finished bag 80 produced by the vertical FFS machine is generally depicted in FIG. 6. The width and height dimensions of the bag may vary from the illustrated dimensions, depending on whether the bag is produced by the horizontal FFS machine in FIG. 2 or the vertical FFS machine in FIGS. 3–5.

Figure 7:
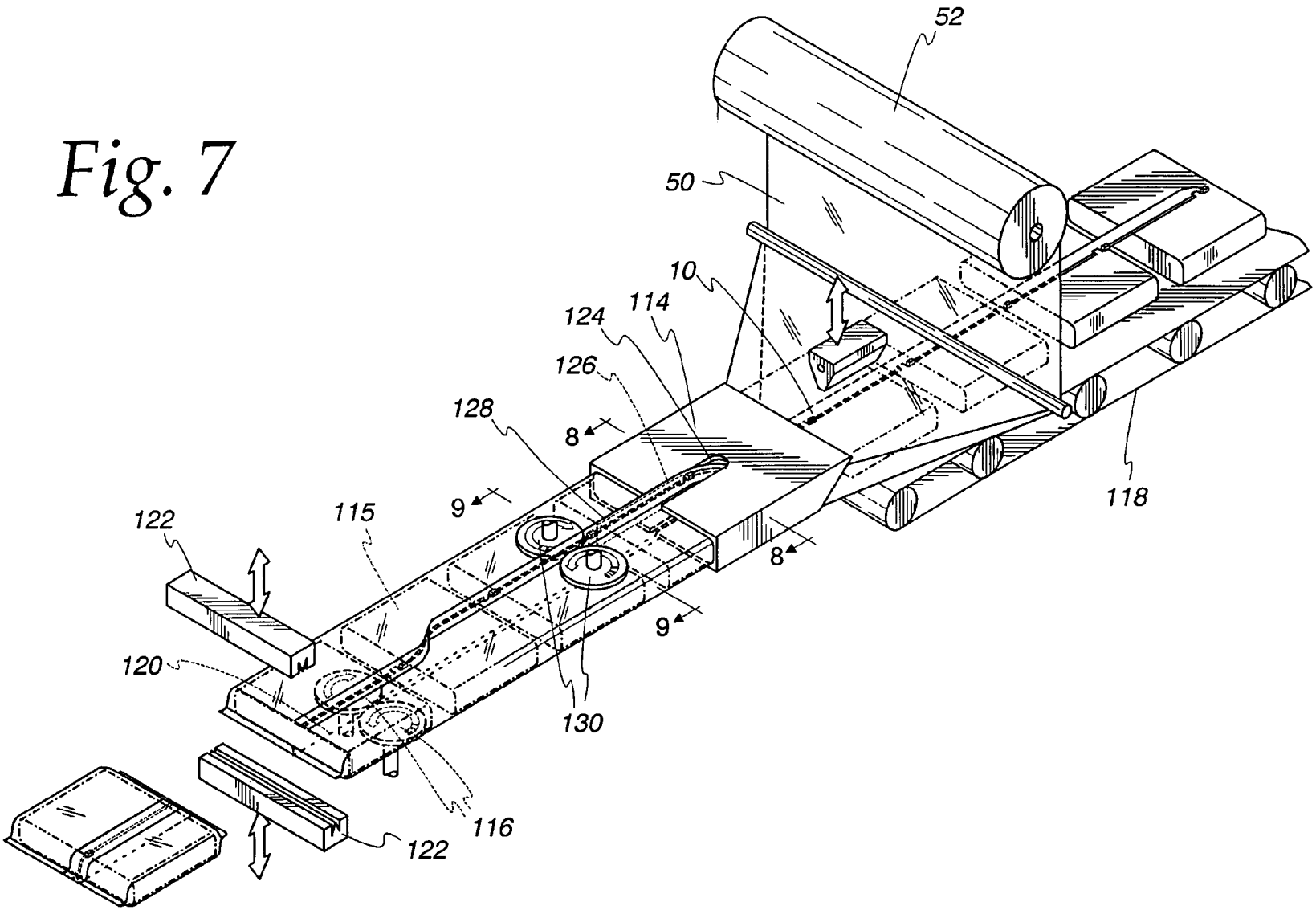
FIG. 7 depicts a method and apparatus for attaching the slider-operated fastener to a flat web of plastic film and then conveying the web to a horizontal FFS machine in the form of a flow wrapper.

FIG. 7 depicts a method and apparatus for attaching the slider-operated fastener 10 to the flat web 50 of plastic film and then conveying the web 50 to a horizontal FFS machine in the form of a flow wrapper. The flow wrapper forms a bag or pouch by wrapping the web 50 around a product, forming a tube with a fin seal, and sealing the ends. The flow wrapper may be used for a variety of products including, for example, snack foods, ice cream bars, bakery items, novelties, medical supplies, hardware, and other small lightweight items. The web can be made of polyethylene, polypropylene, treated paper, laminates, and other wrapping materials that may be heat sealed. Materials that do not heat seal naturally may be given heat seal characteristics by treating or laminating them with heat sealing materials. The pouches may be made with or without gussets at the ends.

Referring to FIG. 7, the fin of the fastener 10 is "tacked" or lightly sealed to a central portion of the moving web 50 of plastic film unwound from a film roll 52. Alternatively, the fastener 10 may be attached near an edge of the moving web 50. After tacking the fastener 10 to the web 50, the fastener-carrying web 50 is conveyed to the flow wrapper. The web 50 is fed from the roll 52 into a former 114. A smooth uniform flow of the web 50 is provided by the force that is produced by passing the edges of the web through a pair of adjacent fin seal wheels 116. The web 50 flows into the former 114 over its plough-shaped wings that shape it into a tube around a product 115 as it is being delivered by a conveyor 118.

Figure 8:
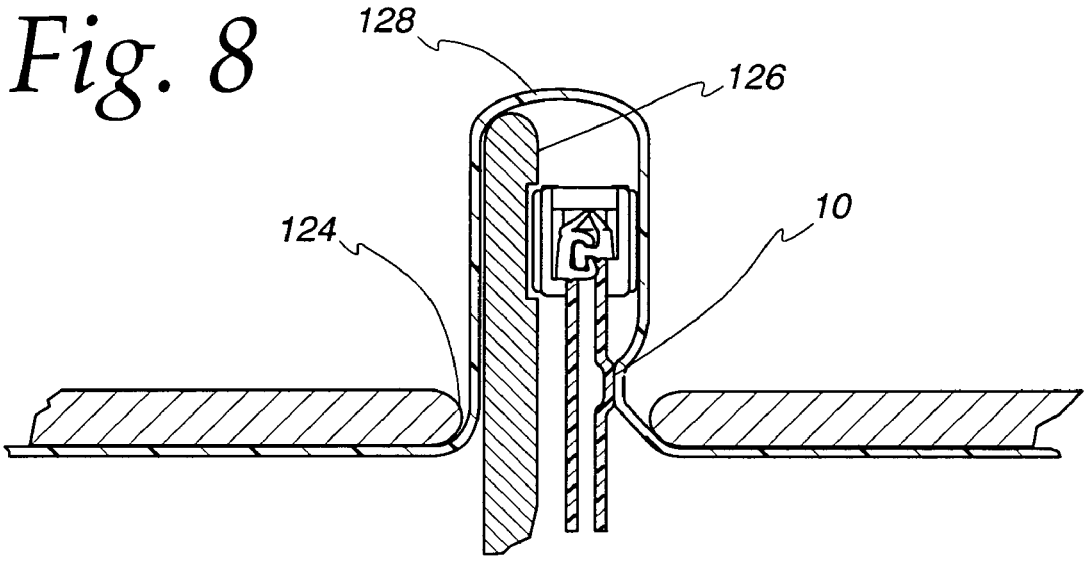
FIG. 8 is a section taken generally along line 8—8 in FIG. 7.
Figure 9:
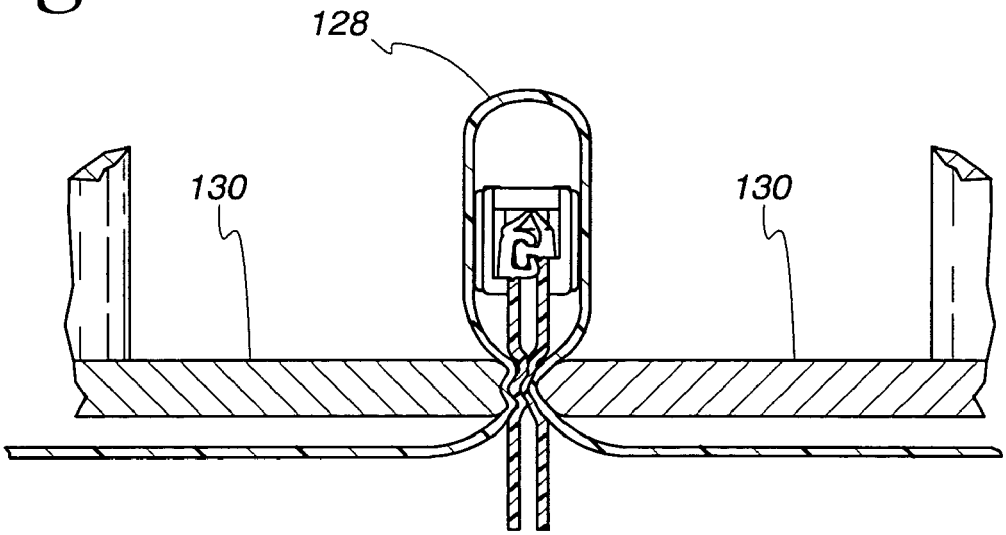
FIG. 9 is a section taken generally along line 9—9 in FIG. 7.

The former 114 includes an upper slot 124 (see FIG. 8) and a loop-forming bar 126 extending upward through the slot 124. The slot 124 extends inwardly from a downstream end of the former 114 and cooperates with the bar 126 to create a C-fold 128 in the web 50. The fastener 10 is positioned slightly off the centerline of the web 50 so that when the web 50 is forced through the slot 124 by the bar 126, the fastener 10 is located to one side of the C-fold 128. A pair of fastener seal wheels 130 (see FIG. 9) permanently seal the fastener fins to the opposing sides of the C-fold 128. This seal is made as the C-fold 128 and fastener 10 are pulled through the seal wheels 130. The two seal wheels 130 have interlocking sets of grooves that make corrugations in the seal as the C-fold 128 and fastener 10 are pulled between the wheels. The wheels 130 are heated to bring the web 50 up to the sealing temperature as the corrugation is made. If the web 50 requires a higher sealing temperature, a set of smooth wheels may also be used to preheat the C-fold 128 and fastener 10 before they enter the seal wheels 130. The amount of pressure exerted by the seal wheels 130 on the web 50 is important for good sealing. The pressure is regulated by adjusting the clearance between the two wheels.

The former 114 also shapes the longitudinal edges of the web 50 into two flaps, or fins, which are sealed together downstream from the fastener seal wheels 130. The fin seal 120 is generally opposite the C-fold 128 containing the fastener 10 and is made as the fin flaps of the tube are pulled through a pair of fin seal wheels 116. The two fin seal wheels 116 have interlocking sets of grooves that make corrugations in the seal as the fins are pulled between the wheels. The wheels 116 are heated to bring the web 50 up to the sealing temperature as the corrugation is made. If the web 50 requires a higher sealing temperature, a set of smooth fin wheels may also be used to preheat the fins before they enter the fin seal wheels 116. The amount of pressure exerted by the fin seal wheels 116 on the web 50 is important for good sealing. The pressure is regulated by adjusting the clearance between the two wheels. The tightness or looseness of the wrap around the product 115 can be adjusted by tilting the fin seal wheels 116. Tilting the fin seal wheels 116 toward the discharge end of the machine will draw more film between the wheels and product a wider fin seal and a tighter wrap. Tilting the fin seal wheels 116 toward the in-feed end will pull less material between the wheels and loosen the wrap.

After generating the fin seal 120, the ends of the pouch are sealed by a pair of cross-sealing jaws 122. The cross-sealing jaws 122 combine a pair of end-sealing sections with a cutoff device in between. One of the end-sealing sections seals the trailing end of one pouch, while the other end-sealing section seals the leading end of a succeeding pouch. The cutoff device, which can be a knife or a hot wire, operates during the jaw closing/sealing operation. This means that when the jaws are open, the filled pouch can be discharged from the flow wrapper. The cross (end) seals are generated in line with the preseals and notches produced by the fastener manufacturing method in FIG. 1.

While the present invention has been described with reference to one or more particular embodiments, those skilled in the art will recognize that many changes may be made thereto without departing from the spirit and scope of the present invention. For example, the fastener 10 may be attached to the flat web 50 prior to forming the preseal 28 and notch 38, installing the slider 40, and applying the end stops 42 and 44. To allow the fastener 10 to be accessed for such operations, however, the operations are preferably performed prior to conveying the web 50 to a horizontal or vertical FFS machine. Also, the equipment used in the fastener and bag manufacturing processes may be modified so that the processes are entirely continuous with no temporary stoppages in the movement of the fastener or bag making web. Thus, any and all of the unit operations may be performed (1) during a continuous web motion such as a rotary or continuous draw machine or (2) during the web index of an intermittent motion machine. Each of these embodiments and obvious variations thereof is contemplated as falling within the spirit and scope of the claimed invention, which is set forth in the following claims.

What is claimed is:

1. A method of making reclosable plastic bags, comprising the acts of:

mounting a plurality of sliders to a continuous length of fastener by inserting the plurality of sliders through notches in the continuous length of fastener, the fastener including mating male and female profiles, each of the notches extending into the male and female profiles and having a length parallel to the lengths of the profiles that allows for insertion of one of the sliders;

attaching the continuous length of fastener to a moving web of plastic film;

after mounting the sliders to the fastener and attaching the fastener to the moving web, forming the web into successive bags including folding the web; and successively filling and sealing the successive bags.

2. The method of claim 1, wherein the mounting of the sliders to the fastener occurs prior to attaching the fastener to the moving web.

3. The method of claim 1, wherein the forming the web into the successive bags and the successively filling and sealing the bags are performed on a horizontal form-fill-seal machine.

4. The method of claim 1, wherein the forming the web into the successive bags and the successively filling and sealing the bags are performed on a vertical form-fill-seal machine.

5. The method of claim 1, wherein the fastener is attached to the moving web near a center of the web and in a direction of web movement.

6. The method of claim 5, wherein forming the web into the successive bags includes:

folding the web generally in half to provide a pair of opposing panels joined along a longitudinal fold, the fastener being located near the longitudinal fold; and sealing the opposing panels to each other at spaced side seals transverse to the direction of web movement.

7. The method of claim 1, wherein the step of forming the web into the successive bags includes:

drawing the web between a collar and a bag-forming tube encompassed by the collar;

sealing opposing longitudinal edges of the web to each other alongside the bag-forming tube so that the web is wrapped around the bag-forming tube; and cross-sealing the web below the bag-forming tube.

8. The method of claim 1, wherein the fastener is attached to the moving web near its edge and in the direction of web movement.

9. A method of making reclosable plastic bags, comprising the acts of:

mounting a plurality of sliders to a continuous length of fastener by installing the plurality of sliders at spaced locations along the continuous length of fastener, the fastener including mating male and female profiles, the mounting including inserting the sliders through notches in the fastener, each of the notches extending into the male and female profiles and having a length parallel to the lengths of the profiles that allows for insertion of one of the sliders;

subsequent to the mounting of the sliders, attaching the continuous length of fastener to a moving web of plastic film at an attachment location on the web, the attachment location on the web being flat and unfolded; and after attaching the continuous length of fastener to the moving flat web, directly conveying the moving web to a form-fill-seal machine where the web is formed into successive bags that are successively filled and sealed.

10. A method of making reclosable plastic bags, comprising the acts of:

mounting a plurality of sliders to a continuous length of fastener by inserting the plurality of sliders through notches in the continuous length of fastener, the fastener including mating male and female profiles, each of the notches extending into the male and female profiles and having a length parallel to the lengths of the profiles that allows for insertion of one of the sliders;

attaching the continuous length of fastener to a moving web of plastic film; and after mounting the sliders to the fastener and attaching the fastener to the moving web, conveying the moving web to a form-fill-seal machine where the web is formed into successive bags that are filled and sealed.

11. The method of claim 10, wherein the fastener is attached to the moving web near a center of the web and in a direction of web movement.

12. The method of claim 11, wherein forming the web into the successive bags includes:

folding the web generally in half to provide a pair of opposing panels joined along a longitudinal fold, the fastener being located near the longitudinal fold; and sealing the opposing panels to each other at spaced side seals transverse to the direction of web movement.

13. The method of claim 10, wherein the step of forming the web into the successive bags includes:

drawing the web between a collar and a bag-forming tube encompassed by the collar;

sealing opposing longitudinal edges of the web to each other alongside the bag-forming tube so that the web is wrapped around the bag-forming tube; and cross-sealing the web below the bag-forming tube.

* * * * *